US005230192A

United States Patent [19]

Webb et al.

[11] Patent Number: 5,230,192

[45] Date of Patent: Jul. 27, 1993

[54] VENTILATED ROOFING SYSTEM

[75] Inventors: William C. Webb, Arden; Richard G. Tuttle, Hendersonville; Donald W. Schultz, Asheville; Ralph Kirby, Asheville; John B. Hickman, Asheville; Nelson M. Ferg, Asheville; Mark D. Braine, Asheville, all of N.C.

[73] Assignee: W. P. Hickman Company, Asheville, N.C.

[21] Appl. No.: 798,230

[22] Filed: Nov. 26, 1991

[51] Int. Cl.[5] ..... E04B 1/62

[52] U.S. Cl. ..... 52/395; 52/465; 52/466; 52/404; 52/545; 52/547; 52/408; 52/303; 52/302

[58] Field of Search ..... 52/465, 466, 200, 202, 52/203, 404, 395, 545, 547, 302, 303

[56] References Cited

U.S. PATENT DOCUMENTS

| | | | |
|---|---|---|---|
| 3,343,309 | 9/1967 | Netz et al. . | |
| 3,447,273 | 6/1969 | Thom . | |
| 4,009,548 | 3/1977 | Hicks . | |
| 4,117,638 | 10/1978 | Kidd | 52/200 |
| 4,155,206 | 5/1979 | Player | 52/200 |
| 4,366,656 | 1/1983 | Simpson | 52/395 |
| 4,437,283 | 3/1984 | Benoit . | |
| 4,472,913 | 9/1984 | Hickman . | |
| 4,476,658 | 10/1984 | Johnstone | 52/395 |
| 4,520,610 | 6/1985 | Simpson et al. . | |
| 4,534,148 | 8/1985 | Simpson et al. . | |
| 4,543,758 | 10/1985 | Lane . | |
| 4,586,301 | 5/1986 | Hickman . | |
| 4,602,468 | 7/1986 | Simpson . | |
| 4,617,770 | 10/1986 | Hickman . | |
| 4,620,397 | 11/1986 | Simpson et al. . | |
| 4,641,475 | 2/1987 | Berridge | 52/466 X |
| 4,649,684 | 3/1987 | Petree | 52/395 |
| 4,741,132 | 5/1988 | Emblin . | |

FOREIGN PATENT DOCUMENTS

| | | | |
|---|---|---|---|
| 2230552 | 1/1974 | Fed. Rep. of Germany . | |
| 2316266 | 10/1974 | Fed. Rep. of Germany . | |
| 1128360 | 1/1957 | France . | |
| 2012637 | 3/1970 | France . | |
| 447814 | 5/1949 | Italy | 52/543 |
| 1104027 | 2/1968 | United Kingdom . | |
| 2084628A | 4/1982 | United Kingdom . | |
| 2162877A | 2/1986 | United Kingdom . | |

*Primary Examiner*—Richard E. Chilcot, Jr.
*Assistant Examiner*—Beth A. Aubrey
*Attorney, Agent, or Firm*—Harness, Dickey & Pierce

[57] ABSTRACT

A roofing system having preferred metallic roofing panels overlying a roof structure or a substrate (such as a waterproof membrane) includes a mat of loosely-woven ventilation mesh material between the panels and the roof structure or substrate in order to provide proper ventilation, thus minimizing corrosion resulting from condensed moisture. The mesh is preferably composed of an extruded thermosetting plastic material.

35 Claims, 2 Drawing Sheets

FIG. 3.
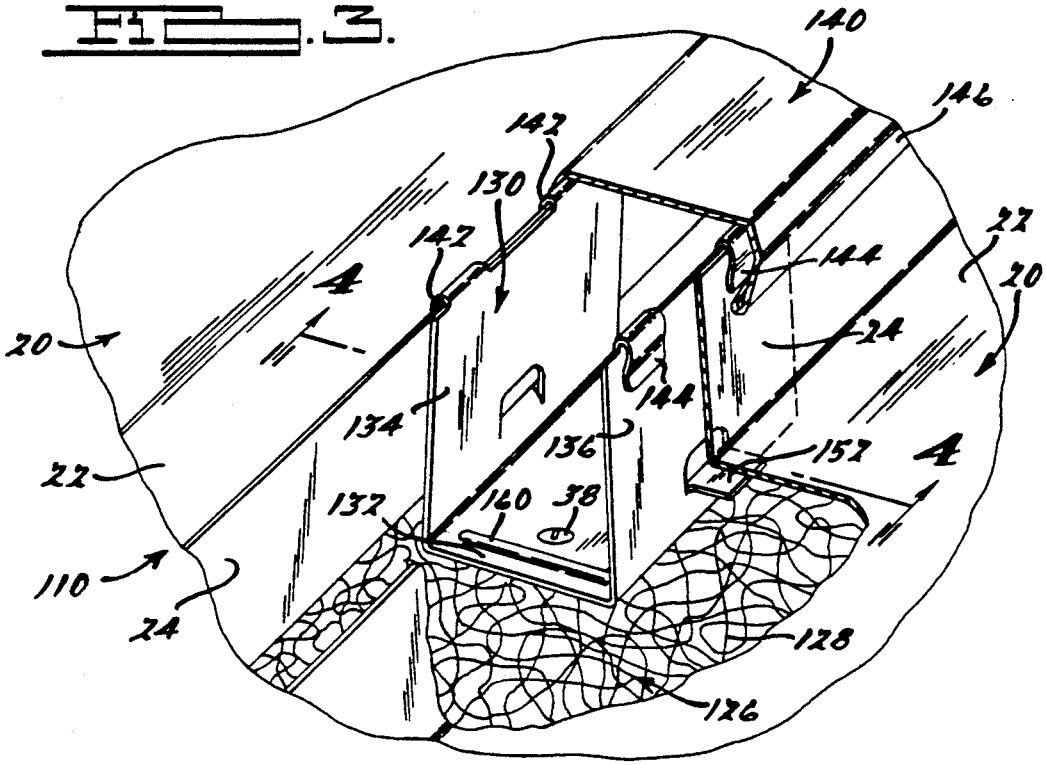
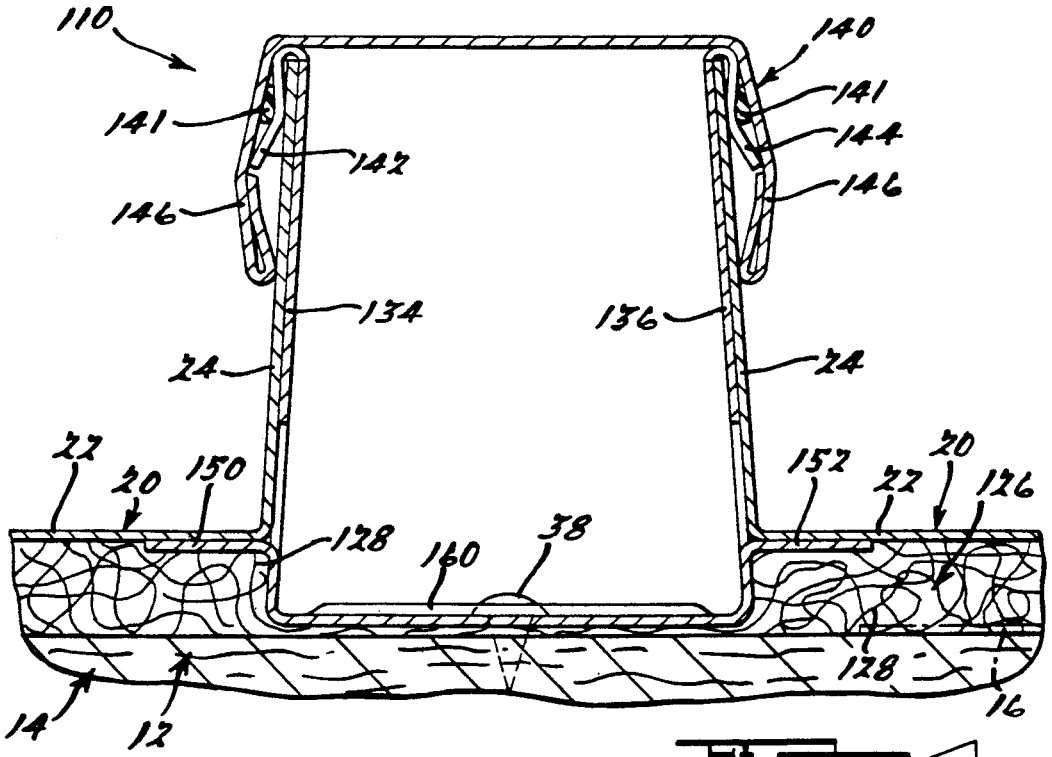
FIG. 4.

VENTILATED ROOFING SYSTEM

BACKGROUND AND SUMMARY OF THE INVENTION

The present invention relates generally to metallic, panel-type roofing systems, and more particularly to such roofing systems that include ventilation between metallic roofing panels and a roof structure or substrate.

In various types of roofing systems employing metallic panels to form the roof covering, it is important to provide for a flow of ventilation air in the space between the metallic roofing panels and the roof structure or other substrate. Such ventilation is necessary in order to substantially prevent or at least minimize the accumulation of standing condensed water, which can react with surrounding materials, such as the substrate or the metal panels themselves, and result in corrosion.

In an attempt to provide such ventilation, prior roofing systems have included a variety of arrangements for separating the metal panels from the substrate or roof structure. Such devices have included corrugated, galvanized strips, which are placed beneath the metal panel as a spacer, but it has been found that such rigid strips are somewhat difficult and time-consuming to install, as well as failing to provide adequate, free ventilation between the panel and substrate or roof structure.

Another system uses a thermoplastic sheet material that has dimples or protrusions thereon in order to maintain the proper ventilation space. Such sheets have been found to be disadvantageous due to the temperature sensitivity of thermoplastic materials, which can result in the dimples or protrusions melting and collapsing in high-temperature environments. Once such dimples or protrusions have collapsed, the ventilation space can become obstructed.

In order to overcome the above-described difficulties and disadvantages of prior roofing systems, the present invention provides a ventilated roofing assembly for covering a roof structure on a building, with the roofing assembly including a sheet-like ventilation mat adapted to be placed in an overlying relationship with the roof structure, and with the ventilation mat being of a relatively loosely woven mesh configuration, in order to allow air to flow therethrough. The mesh-type ventilation mat, which is preferably composed of extruded nylon or other thermosetting materials, is placed between an outer roofing panel and the roof structure or substrate, with a mounting member provided for securing both the ventilation mat and the roofing panel to the roof structure.

In a preferred form of the invention, the outer roofing panel includes a generally planar panel portion overlying the ventilation mat, with at least one panel flange extending generally transversely from an edge portion of the planar portion. The mounting member preferably includes a base portion disposed between the planar portion of the roofing panel and the ventilation mat, a mounting flange portion extending generally transversely relative to the base portion for generally flatly engaging the panel flange of the roofing panel, one or more fasteners extending through the base portion and the ventilation mat and into the roof structure, and an attachment for securing the mounting flange and the panel flange to one another with the planar portion of the roofing panel spaced away from the roof structure and with the ventilation mat disposed therebetween. Preferably, the attachment includes one or more attachment tabs protruding from the mounting flange portion and bent over the panel flange during installation in order to interlockingly secure the mounting flange portion and the panel flange to one another. Furthermore, the invention preferably includes one or more spacing tabs protruding from the mounting flange portion of the mounting member, with the roofing panel engaging the spacing tabs and being supported thereby in order to maintain a predetermined spaced distance between the planar portion of the roofing panel and the roof structure or substrate.

Additional objects, advantages, and features of the present invention will become apparent from the following description and appended claims, taken in conjunction with the accompanying drawings.

BRIEF DESCRIPTION OF THE DRAWINGS

FIG. 3 is a partial perspective view, with portions cut away, similar to that of FIG. 1, but illustrating an alternate embodiment of a ventilated roofing system according to the present invention.

FIG. 4 is a partial cross-sectional view, taken generally along line 4—4 of FIG. 3.

DETAILED DESCRIPTION OF THE PREFERRED EMBODIMENTS

Figure 1:
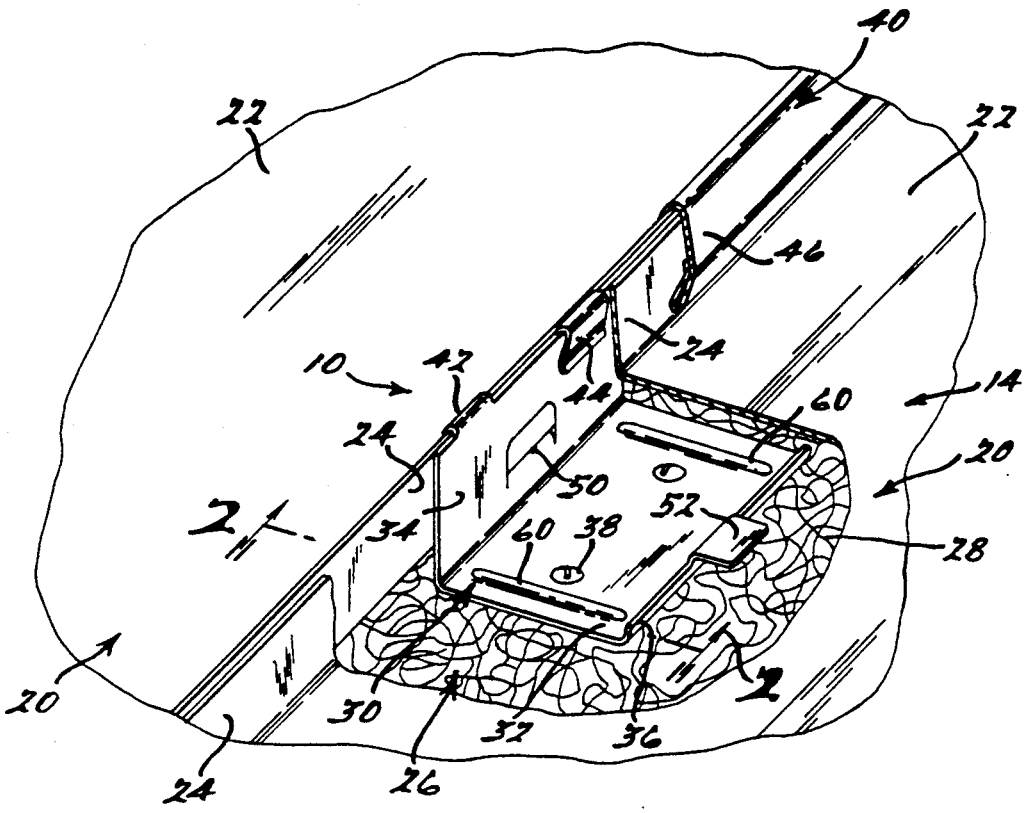
FIG. 1 is a partial perspective view, with portions broken away for clarity, of a ventilated roofing system according to the present invention.

FIGS. 1 through 4 illustrate merely exemplary preferred embodiments of the present invention, as applied in a roofing installation having metal roof panels positioned over an underlying roof structure or substrate, with ventilation being provided between the metal panels and the roof structure. One skilled in the art will readily recognize from the following discussion that such illustrative embodiments are merely exemplary, and that the present invention is also applicable to roofing installations other than the exemplary embodiments depicted in the drawings.

Figure 2:
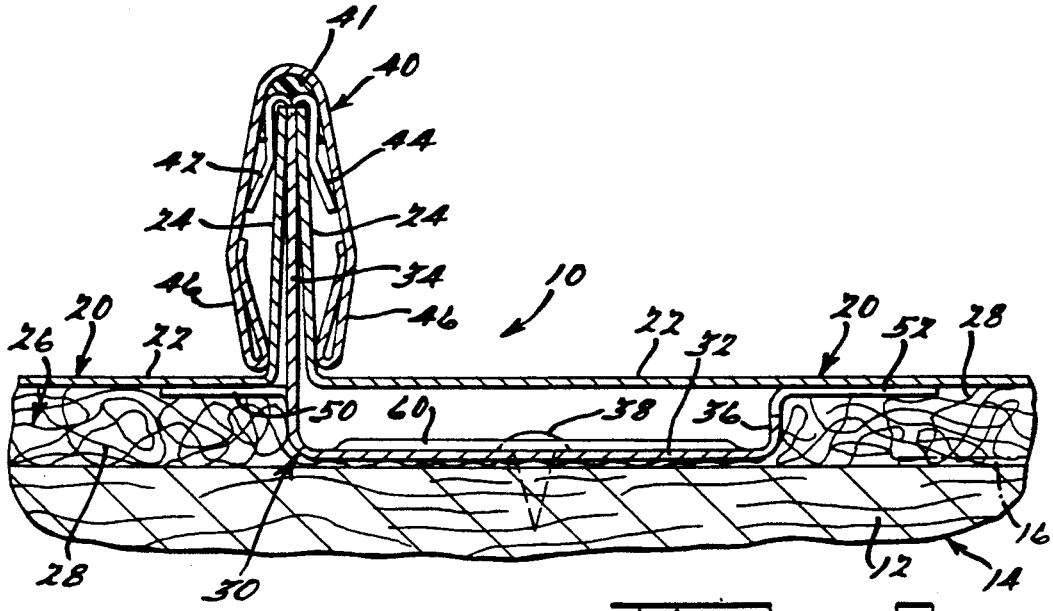
FIG. 2 is a partial cross-sectional view taken generally along line 2—2 of FIG. 1.

Referring to FIGS. 1 and 2, a roofing assembly 10 according to the present invention is illustrated on a roof structure 12 of a building 14, and is equally applicable if the roofing assembly 10 is placed directly upon the roof structure 12, or if the roof structure 12 has an optional roofing membrane or other substrate 16, as illustrated in phantom lines in FIG. 2.

The roofing assembly 10 preferably includes a number of adjacent roofing panels 20, each of which has a generally flat planar portion 22 and a panel flange 24 extending transversely upwardly or outwardly relative to the planar portion 22, preferably with the planar portions 22 being disposed at edge portions of the adjacent planar portions 22. The roofing panels 20 are preferably metal panels, and most preferably are composed of zinc-bearing materials, such as alloys containing zinc, copper, and titanium, in order to resist corrosion.

In order to provide proper ventilation between the roofing panels 20 and the roof structure 12, a ventilation mat 26 is disposed therebetween. The preferred ventilation mat 26 is a relatively loosely woven mesh structure to allow for the free flow of ventilation air therethrough, and is preferably composed of extruded nylon fibers 28 or fibers formed of other thermosetting plastic materials. Such a thermosetting plastic composition allows the ventilation mat 26 to withstand high temperatures, which are frequently encountered in roof installations, without collapsing or otherwise deteriorating and destroying the integrity of the ventilation space between the roofing panels 20 and the roof structure 12.

In order to secure the roofing panels 20 and the ventilation mat 26 to the roof structure 12, one or more mounting members 30 are provided, each of which having a generally flat base portion 32 and one or more mounting flange portions 34 and 36 extending transversely relative to the base portion 32. The mounting members 30 are secured to the roof structure 12 by way of conventional fasteners 38 extending through the base portion 32, the ventilation mat 26, and into the roof structure 12, thus securing the base portion 32 and the ventilation mat 26 to the roof structure 12.

Preferably, the mounting flange portions 34 and 36 have respective spacing tabs 50 and 52 extending transversely therefrom for engaging and vertically or outwardly supporting the adjacent roofing panels 20, with the mounting flange portion 36 terminating at or below the spacing tab 52 in the embodiment depicted in FIGS. 1 and 2 in order to provide clearance for the planar portion 22 of the roofing panel 20 extending above the mounting flange 36. In order to secure the roofing panels 20 to the mounting member 30, and thus to the roof structure 12 in the embodiment of FIGS. 1 and 2, the mounting flange portion 34 preferably has attachment tabs 42 protruding from its upper or outward edge, with the attachment tabs 42 being capable of being bent, in opposite directions, over the adjacent panel flanges 24 of the adjacent panel portions 22, thus interlockingly securing the adjacent panel flanges 24 in a generally flat engagement with the mounting flange portion 34, and thus also securing or anchoring the roofing panels 20 to the roof structure 12.

In the embodiment depicted in FIGS. 1 and 2, wherein the panel flanges 24 of the adjacent roofing panels 20 generally flatly engage opposite sides of the same mounting flange portion 34, a seam cover 40 is provided to cover this joint. The preferred seam cover 40 has a generally U-shaped lateral cross-section defined by a pair of legs 46, as shown in FIG. 2. The seam cover 40 is adapted to be resiliently snapped onto the assembly with the folded-under legs 46 disposed on opposite sides of the panel flanges 24 and the mounting flange portion 34. The legs 46 snugly and preferably resiliently engage the panel flanges 24, and the outwardly diverging ends of the attachment tabs 42 and 44 engage the interior sides of the seam cover legs 46, thus securely covering the joint and anchoring the seam cover 40 thereto.

Besides providing a neat, substantially leak-proof cover for the seam or joint between the panel flanges 24 (with the mounting flange portion 34 therebetween), the preferred snapped-on, resilient engagement of the seam cover 40 over the seam or joint serves to substantially prevent the roofing panels 20 from coming apart in the face of strong winds or other forces that may cause the attachment tabs 42 and 44 to be bent or broken. It should be noted that a sealant material 41 can optionally be applied between the seam cover 40 and seam or joint as shown in FIG. 2.

FIGS. 3 and 4 illustrate another embodiment of the present invention, wherein the roofing assembly 110 is substantially similar in configuration and function to the roofing assembly 10 of FIGS. 1 and 2, with the exceptions discussed below. In this regard, both similar and identical components in the embodiments of FIGS. 1 and 2 and FIGS. 3 and 4 are indicated by like reference numerals, but with the reference numerals of FIGS. 3 and 4 being one-hundred numerals higher.

The roofing assembly 110 is similar to the roofing assembly 10, except that the mounting member 130 includes mounting flange portions 134 and 136 that are the same length and that generally flatly engage respective panel flanges 24 on adjacent, but spaced-apart roofing panels 20. Thus, the attachment tabs 142 on the mounting flange portion 134 are bent in the same direction in order to overlap and interlockingly secure the flatly-engaged panel flange 24 to the mounting flange portion 134, and similarly the attachment tabs 144 on the mounting flange portion 36 are bent in the opposite direction (from that of the tabs 142) to overlap and interlockingly secure the other panel flange 124 to the mounting flange portion 136.

In addition, instead of the seam cover 40 which is provided in the roofing assembly 10 shown in FIGS. 1 and 2, a batten cover 140 is provided for the roofing assembly 110 depicted in FIGS. 3 and 4. The batten cover 140 is also of a generally U-shaped cross-sectional configuration, and is somewhat similar to the configuration of the seam cover 40, except that the legs 146 are spaced farther apart so that the batten cover 140 can span and cover the spaced-apart mounting flange portions 34 and 36, as well as their respective spaced-apart panel flanges 24. As mentioned above, a sealant 141 can optionally be applied beneath the batten cover 141.

In other respects, however, the embodiment depicted in FIGS. 3 and 4 is substantially similar to the roofing assembly 10 depicted in FIGS. 1 and 2, and as mentioned above, many of the components of these two embodiments are identical to, and interchangeable with, one another.

The foregoing discussion discloses and describes merely exemplary embodiments of the present invention for purposes of illustration only. One skilled in the art will readily recognize from such discussion, and from the accompanying drawings and claims, that various changes, modifications and variations can be made therein without departing from the spirit and scope of the invention as defined in the following claims.

What is claimed is:

1. A ventilated roofing assembly for covering a roof structure on a building, said roofing assembly comprising:

a sheet-like ventilation mat adapted to be placed upon the roof structure in an overlying relationship therewith, said ventilation mat having a relatively loosely woven mesh configuration with a plurality of openings therethrough in order to allow air to freely flow therethrough;

at least one outer roofing panel having a generally planar panel portion overlying said ventilation mat and having at least one panel flange extending generally transversely from an edge portion of said planar portion; and mounting means for securing said ventilation mat and said roofing panel to the roof structure, said mounting means including: a base portion disposed between said planar portion of said roofing panel and said ventilation mat; a mounting flange portion extending generally transversely relative to said base portion and generally flatly engaging said panel flange of said roofing panel; fastening means extending through said base portion and said ventilation mat and into said roof structure; and attachment means for securing said mounting flange portion and said panel flange to one another with said planar portion of said roofing panel spaced away from the roof structure and with said ventilation mat being disposed therebetween.

2. A roofing assembly according to claim 1, wherein said ventilation mat is composed of a thermosetting plastic material.

3. A roofing assembly according to claim 2, wherein said thermosetting plastic material is an extruded nylon mesh.

4. A roofing assembly according to claim 1, wherein said roofing panel is composed of a zinc-bearing material.

5. A roofing assembly according to claim 4, wherein said zinc-bearing material is an alloy containing zinc, copper and titanium.

6. A roofing assembly according to claim 1, wherein said attachment means includes an attachment tab protruding from said mounting flange portion and bent over said panel flange in order to interlockingly secure said mounting flange portion and said panel flange to one another.

7. A roofing assembly according to claim 6, further including at least a pair of said roofing panels disposed adjacent one another, said panel flanges of said adjacent roofing panels generally flatly engaging opposite sides of said mounting flange portion, said attachment means including a pair of said attachment tabs, one of said attachment tabs being bent over one of said panel flanges, and the other of said attachment tabs being bent over the other of said panel flanges in order to interlockingly secure both of said panel flanges to said mounting flange portion.

8. A roofing assembly according to claim 1, wherein said mounting means further includes spacing means for supporting said planar portion of said roofing panel at a predetermined spaced distance from the roof structure.

9. A roofing assembly according to claim 8, wherein said spacing means includes a spacing tab protruding from said mounting flange portion generally toward said roofing panel, said roofing panel engaging said spacing tab and being supported thereby.

10. A roofing assembly according to claim 9, further including at least a pair of said roofing panels disposed adjacent one another, said mounting means further including a second mounting flange portion extending generally transversely relative to said base portion and spaced apart from said first mounting flange portion, said spacing means further including a second spacing tab protruding from said second mounting flange portion in a direction opposite that of said first spacing tab, each of said adjacent roofing panels engaging one of said spacing tabs and being supported thereby at said predetermined spaced distance from the roof structure.

11. A roofing assembly according to claim 10, wherein said second mounting flange portion extends transversely from said base portion a distance no greater than the distance from said base portion to said second spacing tab, said panel flanges of said adjacent roofing panels generally flatly engaging opposite sides of said first mounting flange portion, said attachment means including a pair of said attachment tabs, one of said attachment tabs being bent over one of said panel flanges, and the other of said attachment tabs being bent over the other of said panel flanges in order to interlockingly secure both of said panel flanges to said first mounting flange portion.

12. A roofing assembly according to claim 11, further including a generally U-shaped seam cover adapted to be snapped onto said mounting flange portion and said panel flanges.

13. A roofing assembly according to claim 10, wherein said first and second mounting flanges are spaced apart from one another, each of said panel flanges of said adjacent roofing panels generally flatly engaging one of said mounting flange portions, one of said attachment tabs on one of said mounting flange portions being bent over one of said panel flanges, and the other of said attachment tabs on the other of said mounting flange portions being bent over the other of said panel flanges, in order to thereby interlockingly secure said panel flanges to their respective flatly engaged mounting flange portions.

14. A roofing assembly according to claim 13, further including a generally U-shaped batten cover adapted to be snapped over both of said mounting flange portions and both of said panel flanges.

15. A ventilated roofing assembly for covering a roof structure on a building, said roofing assembly comprising:

a sheet-like ventilation mat adapted to be placed upon the roof structure in an overlying relationship therewith, said ventilation mat being composed of a thermosetting plastic material and having a relatively loosely woven mesh configuration with a plurality of openings therethrough in order to allow air to freely flow therethrough;

at least one outer roofing panel having a generally planar panel portion overlying said ventilation mat and having at least one panel flange extending generally transversely from an edge portion of said planar portion; and mounting means for securing said ventilation mat and said roofing panel to the roof structure, said mounting means including: a base portion disposed between said planar portion of said roofing panel and said ventilation mat; a mounting flange portion extending generally transversely relative to said base portion and generally flatly engaging said panel flange of said roofing panel; fastening means extending through said base portion and said ventilation mat and into said roof structure; attachment means for securing said mounting flange portion and said panel flange to one another with said planar portion of said roofing panel spaced away from the roof structure and with said ventilation mat being disposed therebetween, said attachment means including an attachment tab protruding from said mounting flange and bent over said panel flange in order to interlockingly secure said mounting flange portion and said panel flange to one another; and spacing means for supporting said planar portion of said roofing panel at a predetermined spaced distance from the roof structure.

16. A roofing assembly according to claim 15, wherein said thermosetting plastic material is an extruded nylon mesh.

17. A roofing assembly according to claim 15, wherein said roofing panel is composed of a zinc-bearing material.

18. A roofing assembly according to claim 17, wherein said zinc-bearing material is an alloy containing zinc, copper and titanium.

19. A roofing assembly according to claim 15, wherein said spacing means includes a spacing tab protruding from said mounting flange portion generally toward said roofing panel, said roofing panel engaging said spacing tab and being supported thereby.

20. A roofing assembly according to claim 19, further including at least a pair of said roofing panels disposed adjacent one another, said mounting means further including a second mounting flange portion extending generally transversely relative to said base portion and spaced apart from said first mounting flange portion, said spacing means further including a second spacing tab protruding from said second mounting flange portion in a direction opposite that of said first spacing tab, each of said adjacent roofing panels engaging one of said spacing tabs and being supported thereby at said predetermined spaced distance from the roof structure.

21. A ventilated roofing assembly for covering a roof structure on a building, said roofing assembly comprising:

a sheet-like ventilation mat adapted to be placed upon the roof structure in an overlying relationship therewith, said ventilation mat being of a relatively loosely woven mesh configuration with a plurality of openings therethrough in order to allow air to freely flow therethrough;

at least a pair of outer roofing panels, each of said roofing panels having a generally planar panel portion overlying said ventilation mat and each having at least one panel flange extending generally transversely from an edge portion of said planar portion; and mounting means for securing said ventilation mat and said roofing panels to the roof structure, said mounting means including: a base portion disposed between said planar portion of said roofing panel and said ventilation mat; a mounting flange portion extending generally transversely relative to said base portion and being generally flatly engaged on opposite sides by said panel flanges of said roofing panels; fastening means extending through said base portion and said ventilation mat and into said roof structure; attachment means for securing said mounting flange portion and said panel flanges to one another with said planar portions of said roofing panels spaced away from the roof structure and with said ventilation mat being disposed therebetween, said attachment means including a pair of attachment tabs, one of said attachment tabs being bent over one of said panel flanges, and the other of said attachment tabs being bent over the other of said panel flanges in order to interlockingly secure both of said panel flanges to said mounting flange portion; and spacing means for supporting said planar portions of said roofing panels at a predetermined spaced distance from the roof structure.

22. A roofing assembly according to claim 21, wherein said ventilation mat is composed of a thermosetting plastic material.

23. A roofing assembly according to claim 22, wherein said thermosetting plastic material is an extruded nylon mesh.

24. A roofing assembly according to claim 21, wherein said roofing panel is composed of a zinc-bearing material.

25. A roofing assembly according to claim 24, wherein said zinc-bearing material is an alloy containing zinc, copper and titanium.

26. A roofing assembly according to claim 21, wherein said spacing means includes a spacing tab protruding from said mounting flange portion generally toward said roofing panel, said roofing panel engaging said spacing tab and being supported thereby.

27. A roofing assembly according to claim 26, wherein said mounting means further includes a second mounting flange portion extending generally transversely relative to said base portion and spaced apart from said first mounting flange portion, said second mounting flange portion extending transversely from said base portion a distance no greater than the distance from said base portion to said second spacing tab, said spacing means further including a second spacing tab protruding from said second mounting flange portion in a direction opposite that of said first spacing tab, each of said adjacent roofing panels engaging one of said spacing tabs and being supported thereby at said predetermined spaced distance from the roof structure.

28. A roofing assembly according to claim 27, further including a generally U-shaped seam cover adapted to be snapped onto said mounting flange portion and said panel flanges.

29. A ventilated roofing assembly for covering a roof structure on a building, said roofing assembly comprising:

a sheet-like ventilation mat adapted to be placed upon the roof structure in an overlying relationship therewith, said ventilation mat being of a relatively loosely woven mesh configuration with a plurality of openings therethrough in order to allow air to freely flow therethrough;

at least a pair of outer roofing panels, each of said roofing panels having a generally planar panel portion overlying said ventilation mat and each having at least one panel flange extending generally transversely from an edge portion of said planar portion; and mounting means for securing said ventilation mat and said roofing panels to the roof structure, said mounting means including: a base portion disposed between said planar portions of said roofing panels and said ventilation mat; a pair of mounting flange portions extending generally transversely relative to said base portion and spaced apart from one another, one of said mounting flange portions generally flatly engaging one of said panel flanges of one of said roofing panels, and the other of said mounting flange portions generally flatly engaging the other of said panel flanges of the other said roofing panels; fastening means extending through said base portion and said ventilation mat and into said roof structure; attachment means for securing said mounting flange portions and said panel flanges to one another with said planar portions of said roofing panels spaced away from the roof structure and with said ventilation mat being disposed therebetween, said attachment means including an attachment tab on each of said mounting flange portions, one of said attachment tabs being bent over one of said panel flanges, and the other of said attachment tabs being bent over the other of said panel flanges in order to interlockingly secure both of said panel flanges to their respective flatly-engaged mounting flange portions; and further includes spacing means for supporting said planar portions of said roofing panels at a predetermined spaced distance from the roof structure.

30. A roofing assembly according to claim 29, wherein said ventilation mat is composed of a thermosetting plastic material.

31. A roofing assembly according to claim 30, wherein said thermosetting plastic material is an extruded nylon mesh.

32. A roofing assembly according to claim 29, wherein said roofing panel is composed of a zinc-bearing material.

33. A roofing assembly according to claim 32, wherein said zinc-bearing material is an alloy containing zinc, copper and titanium.

34. A roofing assembly according to claim 29, wherein said spacing means includes a spacing tab protruding from each of said mounting flange portions generally toward said respective roofing panels, said roofing panels engaging said spacing tabs and being supported thereby.

35. A roofing assembly according to claim 29, further including a generally U-shaped batten cover adapted to be snapped over both of said mounting flange portions and both of said panel flanges.

* * * * *